United States Patent [19]

Ehrlich, Jr.

[11] 4,177,582

[45] Dec. 11, 1979

[54] SOLE FOR SHOES AND PROCESS FOR THE PRODUCTION THEREOF

[76] Inventor: Johann Ehrlich, Jr., Schulgasse 3, Krems/Weinzierl, Austria, A-3500

[21] Appl. No.: 819,684

[22] Filed: Jul. 27, 1977

[30] Foreign Application Priority Data

Jul. 20, 1976 [AT] Austria ..... 5336/76

[51] Int. Cl.[2] ..... A43B 13/08

[52] U.S. Cl. ..... 36/33; 12/146 B

[58] Field of Search ..... 36/33, 86, 13; 12/146 B; 260/9

[56] References Cited

U.S. PATENT DOCUMENTS

| | | | |
|---|---|---|---|
| 694,872 | 3/1902 | Lockett | 36/33 |
| 2,342,188 | 2/1944 | Ghez et al. | 36/33 |
| 3,440,189 | 4/1969 | Sharp | 260/9 |
| 3,507,057 | 4/1970 | Olsson | 36/86 |

FOREIGN PATENT DOCUMENTS

| | | | |
|---|---|---|---|
| 358308 | 4/1938 | Italy | 36/33 |
| 64575 | 3/1942 | Norway | 36/33 |

*Primary Examiner*—Patrick D. Lawson

*Attorney, Agent, or Firm*—Salter & Michaelson

[57] ABSTRACT

A shoe sole construction and method of making same comprising forward and rearward sole parts of wood having a flexible intermediate part of foamed polyurethane connecting said wood parts. Said polyurethane intermediate part is located adjacent the ball of the wearer's foot and has a laterally extending insert embedded therein, the ends of which are adapted to receive fastening means for securing the shoe upper at that location. During manufacture of the sole, the wooden parts are placed in a mold and then the polyurethane is introduced so as to form the intermediate part which upon curing, chemically bonds to the wooden parts.

9 Claims, 7 Drawing Figures

SOLE FOR SHOES AND PROCESS FOR THE PRODUCTION THEREOF

BACKGROUND AND SUMMARY OF THE INVENTION

The present invention refers to a sole for shoes particularly consisting of two preformed wooden parts being mutually connected at the area of the ball of the foot by means of an intermediate part.

Soles consisting of wood are already known. Such soles provide a comfortable feeling on walking and have the additional advantage that wood performs a humidity regulating action and thus absorbs excessive sweat and later releases the absorbed humidity. The stiffness of a sole consisting of wood is, however, particularly disturbing at the area of the ball of the foot, because, on walking, the feet shall only be supported at the area of their balls which is difficult, or even not possible, with a stiff sole consisting of wood.

For this reason, soles were proposed consisting of two preformed wooden parts which were mutually connected at the area of the ball of the foot by means of rubber reinforced by textile fabric (U.S. Pat. No. 1,964,364). Production of such a sole is quite laborious and creates a problem in connecting the intermediate part consisting of reinforced rubber, on the one hand, and both wooden parts, on the other hand. The intermediate part consisting of reinforced rubber must separately be produced in a corresponding mold and subsequently be connected with both wooden parts. The use of adhesives, Per se, do not result in the required secure connection of the intermediate part consisting of rubber with both wooden parts, so that dove-tail-shaped grooves and correspondingly shaped ledges must be provided and, furthermore, nails must be used in this type of connection.

The present invention has as an object to avoid the mentioned drawbacks and to provide a sole consisting of two wooden parts and a flexible intermediate part such that the intermediate part can be produced in a simple manner and can, simultaneously with its production, reliably be connected with both wooden parts. An essential feature of the invention is that the intermediate part consists of foamed polyurethane. When using this material for producing the intermediate part, a reliable connection between the wooden part and the polyurethane results without any additional measures because wood does chemically react with polyisocyanates contained within the polyurethane-forming mixture. Chemical compounds contained in the wood and comprising OH-groups react with their OH-groups with the isocyanate groups of the polyisocyanate and provide an unseparable connection. The required connection is thus formed simultaneously with the production of the flexible intermediate part, so that production of this intermediate part becomes possible in a substantially more economic manner than when separately producing the elastic intermediate part and subsequently connecting this intermediate part with both wooden parts by means of adhesives or in a mechanical manner by means of nails, screws, clips or the like. Furthermore, the polyurethane used has a lower specific weight than rubber, which also contributes to more economical production.

One way the upper of the shoe can be fixed to a sole according to the invention present for instance by pinching the upper over the sole. When using a sole according to the invention for sandals, clogs or the like it is, however, convenient to connect the upper to the sole by means of nails or clips. To achieve the required reliable connection between the upper and the sole, at the area of the intermediate part, there is, according to the invention, provided within the intermediate part at least one insert transversely extending relative to the longitudinal direction of the sole at least up to a lateral boundary of the intermediate part and being adapted to be connected with the upper of the shoe. Such an insert can, for instance, consists of a metallic tie pin or consists of another material such as synthetic plastics material or wood. It is, however, essential that the insert be well anchored within the intermediate polyurethane part and be in the position to provide a mechanically strong connection between the upper and the insert, so that the upper can reliably be connected to the sole also at the area of the intermediate part.

A separate insert can be provided at each of the lateral boundaries of the intermediate part, such inserts thus extending only over a certain distance into the interior of the intermediate part. However, it is convenient to provide, according to a further feature of the invention, at least one insert extending over the whole width of the intermediate part so that the upper can be connected to both ends of the same insert. In such an embodiment the insert is reliably prevented from becoming extracted out of the intermediate part because, if an extracting force is acting on one end of the insert, the other end of the insert would tend to be pulled into the intermediate part, which, however, is prevented by the upper fixed to this end.

According to a preferred embodiment of the sole of the present invention, the intermediate part has a substantially triangular cross section in longitudinal direction of the sole, noting that the base of this triangle, which is preferably an equilateral triangle, is flush with the walking surface of the sole. In such an embodiment, the area of the intermediate part adjacent the sole of the foot is narrow, whereas the area of the intermediate part adjacent the walking surface of the sole is broad. This provides the advantage that one can, when providing a connection with the upper, do with only on insert extending over the whole width of the intermediate part and being arranged within the narrow area of the intermediate part, because in this case the adjacent connecting points for the upper are located at the mechanically strong wooden parts of the sole. In such an embodiment, the connecting surfaces, between the intermediate part and both wooden parts are enlarged so that adhesion of the intermediate part to the wooden parts becomes improved. In this embodiment, the intermediate part is very broad at the area of the walking surface of the sole, so that the specific elongation per centimeter of the intermediate part can be kept low and the intermediate part does not become stressed to destruction by excessive elongation.

The tip of the triangle preferably merges into a lateral web within which the insert is provided. This permits secure anchoring of the insert even in an intermediate part having a triangular cross section.

DESCRIPTION OF THE DRAWING

The invention is further illustrated with reference to the drawing showing various embodiments of a sole according to the invention wherein.

DESCRIPTION OF THE INVENTION

Figure 1:
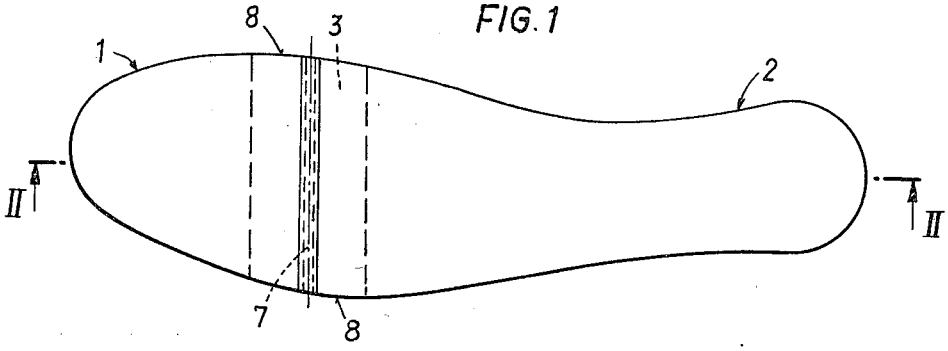
FIG. 1 shows a top plan view of the sole according to the invention.
Figure 2:
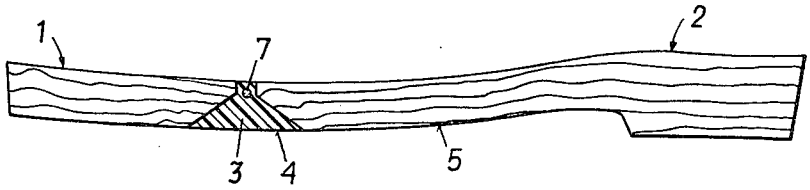
FIG. 2 is a section along line II—II of FIG. 1.

The sole according to the invention consists of a wooden forward portion 1 and of a wooden rearward portion 2, noting that these two portions are mutually connected by an intermediate portion 3 consisting of polyurethane. The intermediate portion 3 is arranged at the area of the ball of the foot and has in a section taken in longitudinal direction of the sole an essentially triangular cross section as shown in FIGS. 2 to 5. The base 4 of the triangle is flush with the walking surface 5 of the forward portion 1 as well as with the walking surface 5 of the rearward portion 2. The tip or apex opposed to this base 4 is shaped to form a web 6 which provides a continuation between the forward portion 1 and the rearward portion 2 at the side adjacent the sole of the foot. This prevents the intermediate part from becoming stressed by peak loads on bending, which loads could otherwise damage the intermediate part.

Within this web 6 an insert 7 is provided which extends transversely to the longitudinal direction of the sole up to the lateral boundaries 8 of the intermediate part 3. This insert 7 serves the purpose 7 of connecting the upper of the shoe with its sole also at the area of the intermediate part 3.

Figure 3:
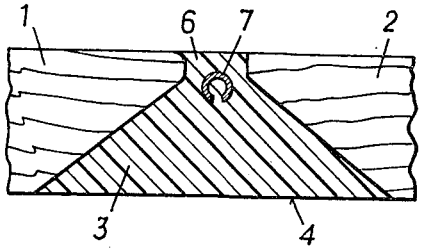
FIGS. 3 to 5 show the shape of the intermediate part in an enlarged scale and the arrangement of various inserts in a section corresponding to the section of FIG. 2.

In the arrangement according to FIG. 3, the insert 7 is formed of a tie pin which consists, in the embodiment shown, of a small metallic tube slotted in longitudinal direction. Within this tube, pins, nails, clips, screws, particularly screws with self-cutting thread, or the like extending through the upper can be anchored.

Figure 4:
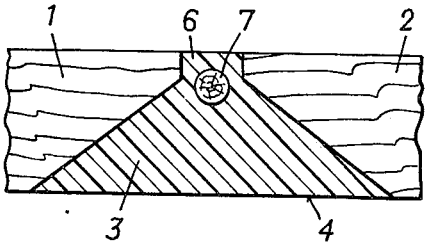
Figure 5:
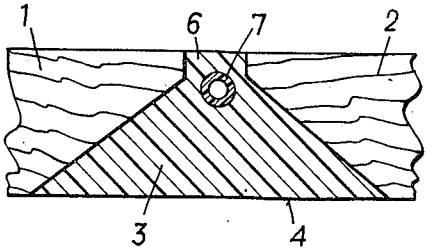

In the embodiment shown in FIG. 4, the insert consists of a wooden pin into which, for the purpose of fastening the upper, nails or clips can be driven or screws can be threaded. The insert shown in FIG. 5 consists of a cylinder of synthetic plastics material, said cylinder being provided with openings into which, for the purpose of fastening the upper, pins, nails, clips, bolts or the like can be introduced.

Figure 6:
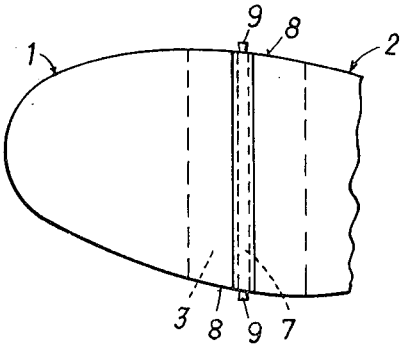
FIG. 6 shows in a top plan view the forward portion of a sole according to the invention together with a further embodiment of the insert.

The insert 7 shown in FIG. 6 is provided with protrusions 9 projecting over the lateral boundaries 8 of the intermediate part 3 and extending through the upper of the shoe and being adapted to be deformed as by formation of a rivet head. Also in this case, the upper can reliably be connected to the shoe at the area of the intermediate part 3. The protrusions 9 can also be provided with an external thread onto which a threaded nut may be placed.

Figure 7:
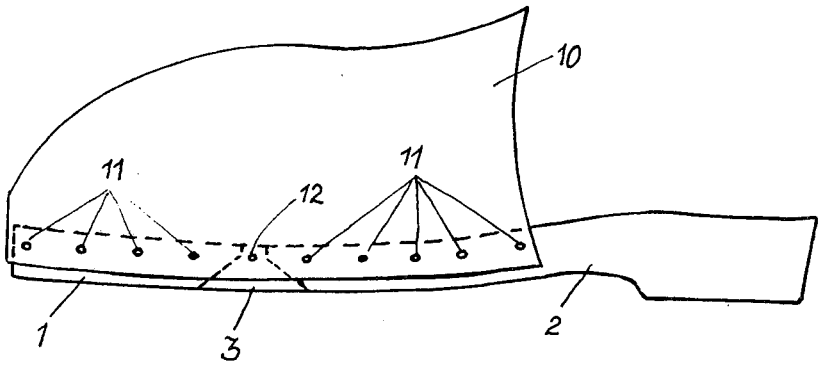
FIG. 7 shows a shoe provided with a sole according to the invention.

FIG. 7 shows a shoe provided with a sole according to the invention. The upper 10 of this shoe is, by means of nails, connected to the sole formed of the two wooden parts 1, 2 and of the intermediate part 3. The nails 11 are driven into the wooden parts 1, 2, whereas the nail 12 is connected with an insert 7 extending up to the lateral boundary of the intermediate part 3.

When producing the sole according to the invention, the forward portion 1 and the rearward portion 2 as well as the insert 7 is placed into a mold or support, respectively, into which subsequently the polyurethane-forming mixture is introduced, for example by injection molding or mere pouring, and allowed to foam. The resulting polyurethane is chemically bounded to the OH-groups of the wood, thus providing an unseparable connection between the wood and the intermediate part 3. In view of the polyurethane having a low specific weight as compared, for instance, with that of rubber, a low injection pressure can be used. The required molds can, therefore, be made of lower weight and of more simple construction. When applying a lower injection pressure any danger of expelling the resulting polyurethane through the mold gaps is reduced, so that the number of rejects is low when producing soles according to the invention.

What I claim is:

1. A sole construction for shoes comprising separate forward and rearward parts constructed entirely of wood, a flexible intermediate part interconnecting said forward and rearward parts, said intermediate part extending across said sole and being located adjacent the area adapted to be engaged by the ball of a wearer's foot, said intermediate part consisting of foamed polyurethane, containing polyisocyanate, chemically bonded to said wooden parts, said chemical bond forming the sole interconnection between said intermediate part and said forward and rearward parts.

2. The sole construction of claim 1 further characterized in that said intermediate part is substantially of triangular cross section, the base of said triangle being flush with the bottom surfaces of said forward and rearward parts.

3. In the sole construction of claim 2, said triangular cross section being substantially equilateral.

4. In the sole construction of claim 2, the apex of said triangular cross section merging into a laterally extending web section, an insert embedded within said intermediate part and extending in a direction transverse to the longitudinal direction of the sole, said insert being located in said web section adjacent said apex and extending to the outer edge of said intermediate part.

5. A sole construction for shoes comprising separate forward and rearward parts constructed entirely of wood, a flexible intermediate part interconnecting said forward and rearward parts, said intermediate part extending across said sole and being located adjacent the area adapted to be engaged by the ball of a wearer's foot, said intermediate part consisting of foamed polyurethane, containing polyisocyanate, chemically bonded to said wooden parts, said chemical bond forming the sole interconnection between said intermediate part and said forward and rearward parts, said sole construction further comprising at least one insert embedded within said intermediate part and extending in a direction laterally across said sole, said insert extending to the outer edge of said intermediate part, whereby to provide support structure for the receipt of means for fastening an upper to said sole.

6. In the sole construction of claim 5, said insert extending from side to side of said sole and having openings at its ends for receiving fastening means therein.

7. In the sole construction of claim 5, said insert having an extension extending beyond the outer edge of said intermediate part, said extension being adapted to pass through a shoe upper for securing the latter to said sole.

8. The method of producing a sole construction comprising the following steps:

(a) forming forward and rearward wooden sole parts separated from each other at a location adjacent the ball of a wearer's foot;

(b) placing said parts in a mold corresponding to the sole to be produced, with the parts spaced from each other at the ball joint area;

(c) introducing foamed polyurethane, containing polyisocyanate, into said area; and (d) allowing said polyurethane to cure, whereby it chemically bonds to said wooden parts.

9. The method of producing a sole construction comprising the following steps:

(a) forming forward and rearward wooden sole parts separated from each other at a location adjacent the ball of a wearer's foot;

(b) placing said parts in a mold corresponding to the sole to be produced, with the parts spaced from each other at the ball joint area;

(c) positioning a transversely extending insert in said mold at said ball joint area;

(d) introducing foamed polyurethane containing polyisocyanate into said area; and (e) allowing said polyurethane to cure, whereby it chemically bonds to said wooden parts with said insert embedded therein.

* * * * *